US005361661A

United States Patent [19]

Faucompre et al.

[11] Patent Number: 5,361,661

[45] Date of Patent: Nov. 8, 1994

[54] MACHINE FOR CONTINUOUSLY CUTTING OPEN BAGS OF PLASMA

[75] Inventors: Annick Faucompre; Jean-Pierre Gigout, both of Marcq-en-Baroeul; Jacques Millard, Noyelles les Seclin; Marc Leprince, Sainghin-en-Weppes, all of France

[73] Assignee: Association pour l'Essor de la Transfusion Sanguine Dans la Region du Nord, Lille, France

[21] Appl. No.: 984,117

[22] Filed: Dec. 4, 1992

[30] Foreign Application Priority Data

Dec. 5, 1991 [FR] France ..... 91 15077

[51] Int. Cl.[5] ..... B26D 7/06; B26F 1/26

[52] U.S. Cl. ..... 83/177; 83/155; 83/425.2; 83/435.2; 83/860

[58] Field of Search ..... 83/177, 417, 425.1, 83/425.2, 435.2, 437, 155, 860

[56] References Cited

U.S. PATENT DOCUMENTS

| | | | |
|---|---|---|---|
| 2,735,466 | 2/1956 | Krstinich | 83/435.2 |
| 3,631,908 | 1/1972 | Meltzer et al. | 83/155 |
| 3,858,473 | 1/1975 | Bystron | 83/155 |
| 4,457,194 | 7/1984 | Mally | 83/417 |
| 4,506,572 | 3/1985 | Kupper | 83/909 |
| 5,031,496 | 7/1991 | Lobash et al. | 83/107 |

FOREIGN PATENT DOCUMENTS

| | | |
|---|---|---|
| 0170369 | 2/1986 | European Pat. Off. . |
| 2531923 | 2/1984 | France . |
| 2252451 | 5/1974 | Germany . |
| 1534296 | 11/1978 | United Kingdom . |

*Primary Examiner*—Hien H. Phan
*Attorney, Agent, or Firm*—Nikaido, Marmelstein, Murray & Oram

[57] ABSTRACT

Machine for continuously cutting open bags of deep frozen plasma including a feed table, a cutting area adjacent the feed table and a collection area. The cutting area has a cutting nozzle for cutting the deep frozen bags of plasma on a longitudinal median portion of the bag. The cutting nozzle emits a cutting jet of water under very high pressure. A conveyor made up of two endless belts continuously travels the deep frozen bags of plasma one after another under the cutting nozzle. The conveyor includes the two side-by-side endless belts mounted around horizontal rollers at opposite ends of a chassis. The belts have a small gap between them which is located vertically in relation to the cutting nozzle. Paired inclined rollers are provided on the chassis adjacent the ends with the endless belts being oriented by the inclined rollers to form in relation to one another a very open V-shaped profile having a tip centered on the gap so that the cutting stream of very high pressure water cutting the bags of plasma in half longitudinally passes through the gap.

4 Claims, 4 Drawing Sheets

MACHINE FOR CONTINUOUSLY CUTTING OPEN BAGS OF PLASMA

The invention relates to a machine for continuously cutting open bags of plasma using jets of water under very high pressure.

When cutting open bags of deep frozen plasma, it is necessary to take a certain number of essential precautions, particularly with regard to sterility and non contamination of the products processed. Hitherto, this operation was generally carried out using a conventional bandsaw, and the cutting table was most often fed by hand, the pieces of bag cut open also being recovered manually, moreover. This somewhat anarchic method does not make for easy, highly symmetrical cutting, unless special complementary guiding systems are used. What is more, the cutting rates are low. In addition, cutting quality is not satisfactory. Indeed, a bandsaw inevitably eats away a width of at least 2 to 3 mm, which leads to quite an appreciable wastage of product. Furthermore, over the entire periphery of the bag, the plastic forming the envelope is torn by the teeth of the saw, giving rise to fragments which adhere to the product and contaminate it. To make matters worse, these fragments may adhere to the saw itself and, as a result, be transferred to the following bag, which has the effect of aggravating the contamination of the plasma. The same applies to the labels stuck on the bags, pieces of these also being dispersed. Finally, the high speed action of a bandsaw necessarily leads to small particles of plasma being sprayed into the surrounding atmosphere.

To obviate these drawbacks, and at the same time improve cutting quality, as well as faciliting automation of the machine while improving the operating rates, the Applicant has developed a machine which implements, as a cutting means, jets of water projected under very high pressure.

One main object of the present invention thus consists in a machine for continuously cutting open bags of plasma among others of human plasma for fractionation delivered from a feed table to an area in which they are cut open, while deep-frozen, into two portions which are then received in a collection area with a view to manually or automatically separating the bag from the plasma, a machine wherein the cutting means is composed of at least one jet of water ejected under very high pressure by a fixed cutting nozzle, which acts on the longitudinal median portion of deep frozen bags of plasma travelling continuously one after another on a conveyor mechanism.

Advantageously, the conveyor mechanism is composed of two endless belts which travel at the same speed side by side and which form between them a small gap located vertically in relation to the cutting nozzle.

The belts travel back about one and the same horizontal roller mounted on each end of the chassis of the machine and are oriented by inclined rollers so as to form in relation to one another a very open V shaped profile the tip of which is centered on the central gap, the belts forming this profile over the entire length of the cutting area.

According to a special feature of the invention, a longitudinal hood covers the endless belts over a portion of their length, on either side of the cutting nozzle, and a single distribution manifold, extending transversely above a plurality of hoods, supplies a plurality of fixed cutting nozzles with water under very high pressure.

Further special features and advantages of the invention will emerge from the following description of a non-limitative example of a form of embodiment, wherein reference is made to the annexed drawings, whereof:

Figure 1:
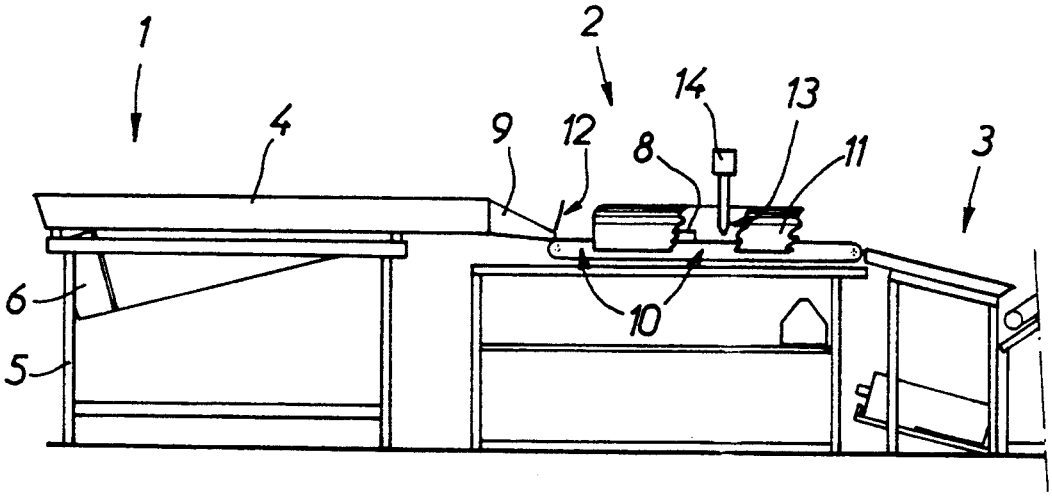
FIGS. 1 and 2 are schematic cross-sectional and plan views of the cutting machine as a whole.
Figure 2:
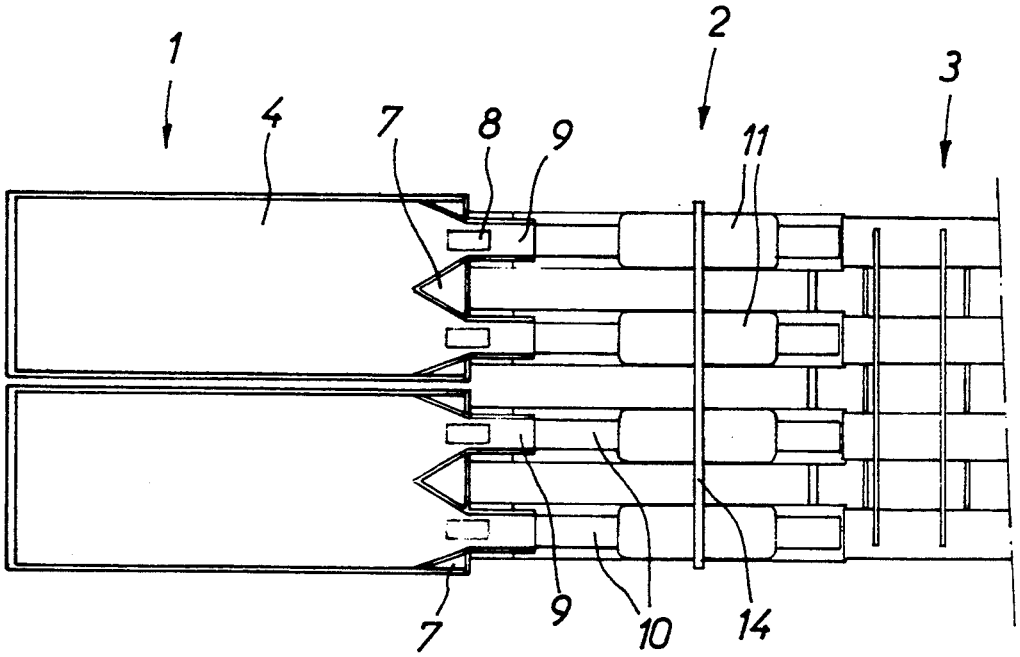

The machine shown in FIGS. 1 and 2 essentially comprises a feed table 1, an area 2 for cutting open bags of plasma and a collection area 3.

In the example shown, the feed table is advantageously composed of two shaking tables 4 mounted on a bearing chassis 5, inside which are housed the motors 6 for driving the table. Each table is clearly designed to displace the bags that it receives in the direction of the cutting area. At its downstream end, deflectors 7 orient the deep frozen bags 8 of plasma so that they arrive one after another in distribution chutes 9, longitudinally with regard to their direction of movement. At the exit from each chute is provided a feed flap 12 capable of releasing the bags regularly in the direction of the following area.

The bags 8 that leave chutes 9 are taken up by conveyor belts 10 which extend over the entire length of cutting area 2 opposite each distribution chute. Each conveyor belt, which will be described in greater detail a little later, penetrates a sort of tunnel formed by a longitudinal hood 11 covering a substantial portion of the belt. Beneath each hood 11, above the median portion of conveyor belt 10, and downwardly oriented, is mounted a fixed cutting nozzle 13 supplied with water under very high pressure by a single distribution manifold 14, extending transversely above several hoods, the manifold being itself connected to a compressor, not represented. At the output from this cutting area 2, the conveyor belt supplies collection area 3 with bags of plasma cut open, which are collected in a receptacle or seized by a mechanism, for the purpose of separating the bags from the plasma.

Figure 3:
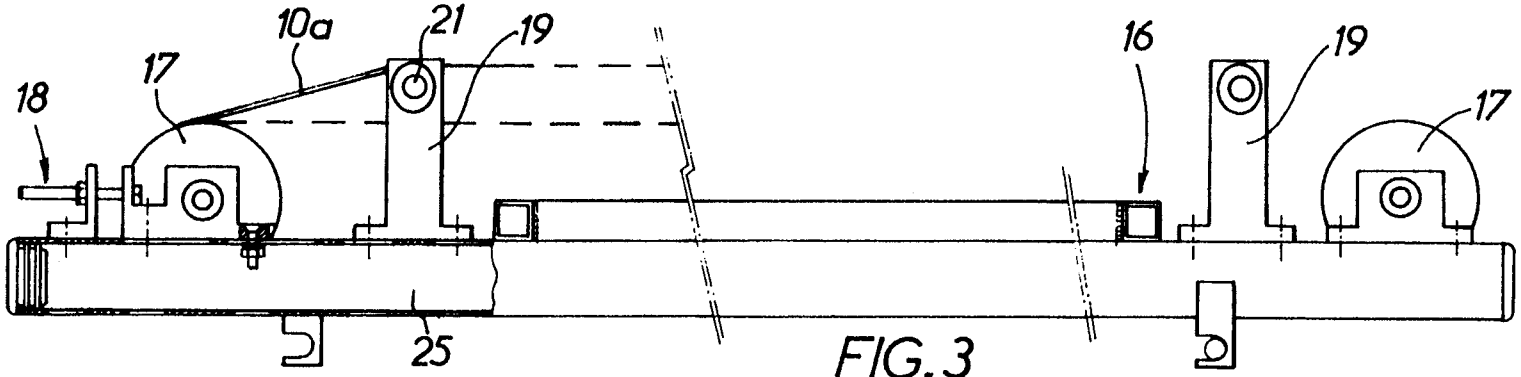
FIGS. 3 and 4 are larger scale cross-sectional and plan views of the supporting chassis for the conveyor belts.
Figure 4:
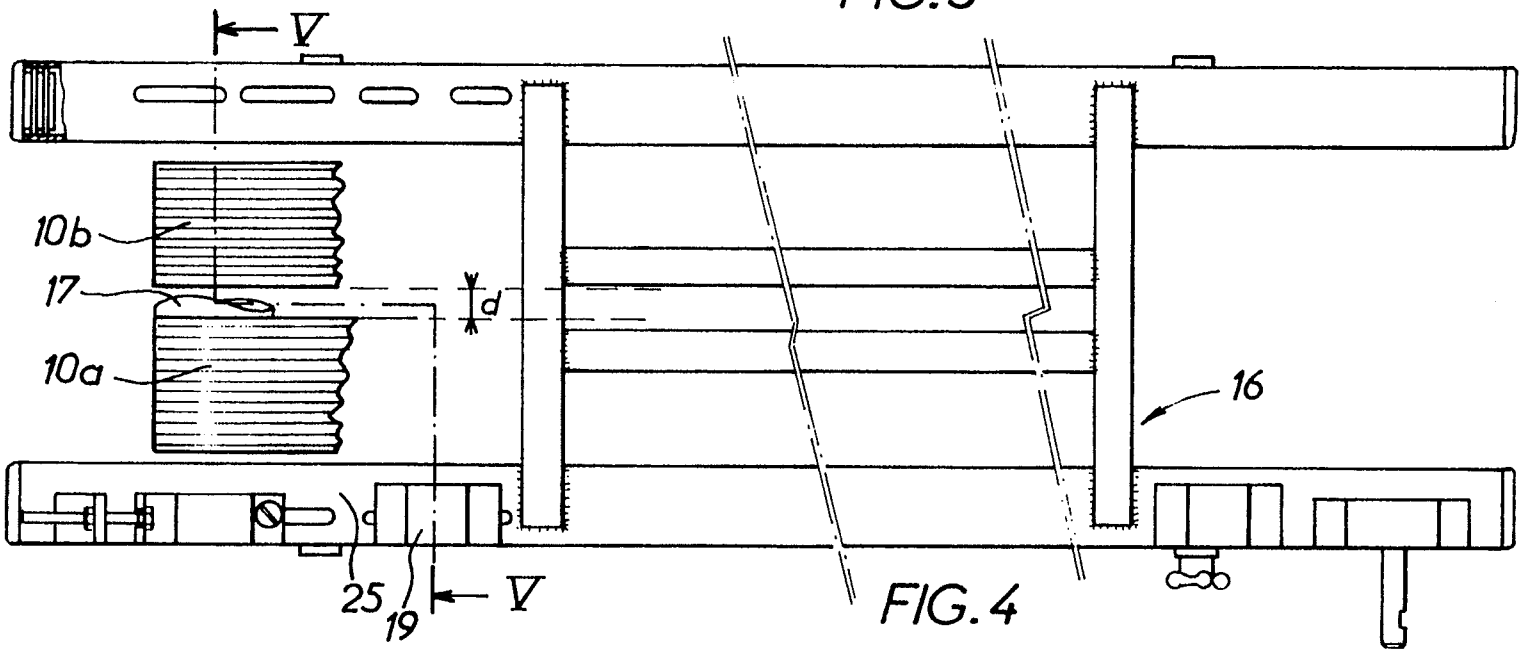
Figure 5:
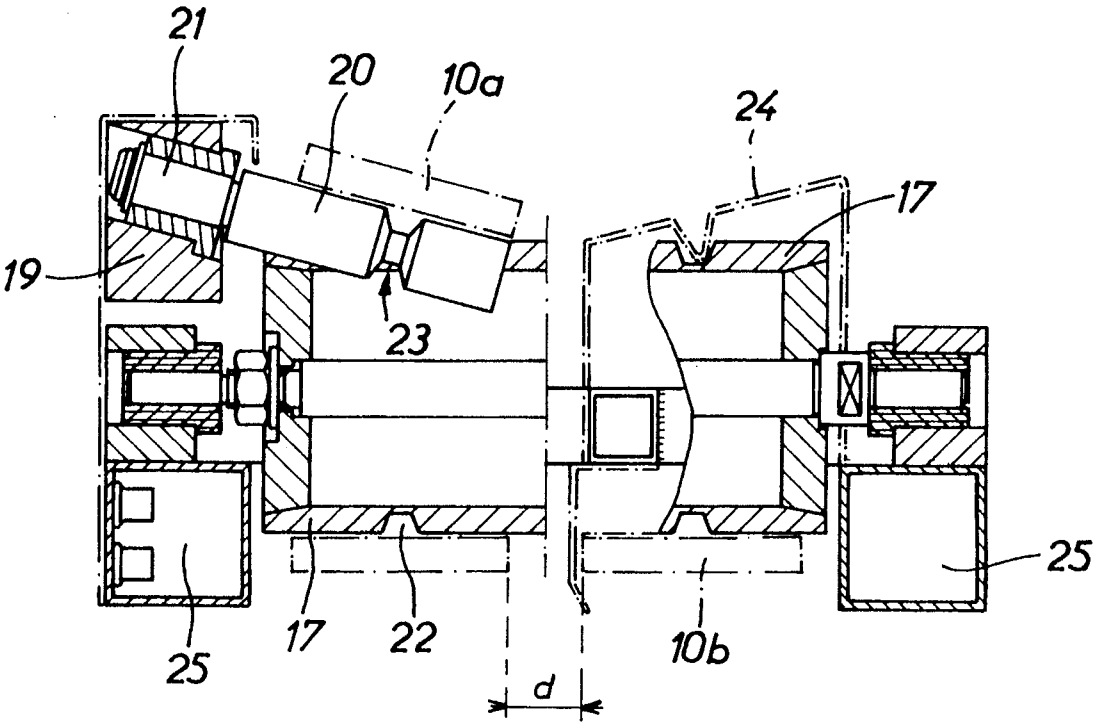
FIG. 5 is a view along line V—V of FIG. 4.

FIGS. 3 and 4 show the support chassis 16 of a conveyor belt 10, while FIG. 5 is a cross-sectional view of an end of the chassis. Belt 10 is, in reality, composed of two longitudinal half belts, 10*a* and 10*b*, which are separated by a small gap d centered in the middle of chassis 16 and which travel side by side at the same speed. This gap is located vertically in relation to the cutting nozzle 13 so that the water projected can pass between the two half belts. The latter travel back over one and the same horizontal roller 17 mounted on each end of the chassis, one of them being capable of longitudinal movement, when subjected to the action of an appropriate mechanism 18, to adjust the tension of the belts. In the vicinity of the rollers, on each of the side members 25 of frame 16, are provided vertical brackets 19. Each bracket 19 serves to cantilever support an idler roller 20 which extends transversely of the chassis over a length substantially equal to the width of a half belt 10. Thus, each idler roller serves as a guide for a corresponding belt. As can be seen from FIG. 5, the support bearing 21 of idler roller 20 is located at the top of the bracket and the idler roller is downwardly inclined in the direction of central gap d. To ensure that half belt 10*a* or 10*b* does not slide towards this central gap, its lower face is provided with a longitudinal rib 22 which cooperates with a groove 23 provided on the idler roller. As we can also see, belts 10*a*, 10*b* are compelled by idler rollers 20 to form in relation to one another a very open V shaped profile, the tip of the V being centered on gap d, this being the case over the entire length of the chassis. In the central area of the latter, that is to say all along cutting area 2 between idler rollers 20, the two V forming belts are supported by a fixed sliding plane 24 the upper face of which is inclined in the same way. It will thus be appreciated that the bags of plasma that drop onto belt 10 are automatically centered above gap d, straddling the said gap and resting on the two half belts 10*a* and 10*b*.

Figure 6:
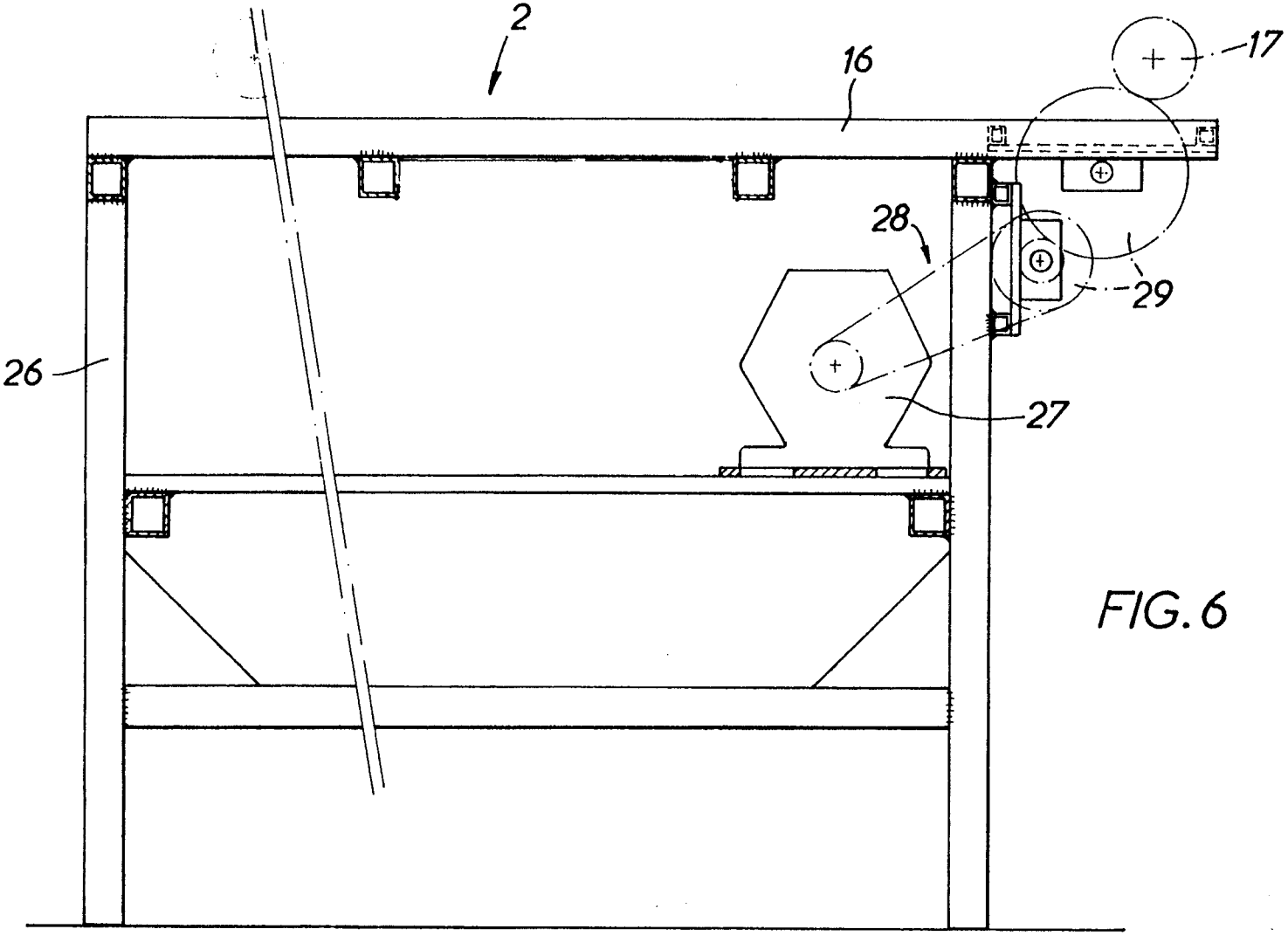
FIG. 6 is an enlarged elevation view of the end of the cutting area.

FIG. 6 gives a more detailed view of the end of cutting area 2 and table 26 which serves to support chassis 16, as well as the motor 27 used to drive a roller 17 via notched belts 28 and idle gears 29.

As soon as the deep-frozen bags 8 of plasma have been delivered by the distribution chutes 9 of shaking tables 4, which is accomplished very regularly thanks to flaps 12, they are positioned longitudinally, one after the other, accurately centered on half belts 10*a* and 10*b*, which will convey them to the cutting area.

Thus, when they are subjected, inside hood 11, to the jet of water ejected continuously by nozzle 13, each bag is cut open perfectly in the longitudinal direction into two equal portions, without any loss of product and without any fragments being torn off. As to the cut half bags, these are received by the collection area and are separated from the plasma manually or automatically. Protective hood 11 obviates any risk of accident to the user, and at the same time restricts any projection of water into the surrounding area.

The frames and chassis serving to support the tables and cutting mechanisms also receive the electric cables supplying the different motors and the controls of the machine. The protective hoods 11, as well as the central guide of the distribution manifold, are equipped with position sensors so that, if they are removed at an untimely moment, the machine is shut down and the pressurized water supply is turned off. This water supply is ensured by a circuit external to the machine, the water being appropriate for the intended use and supplied from a tank.

We claim:

1. Machine for continuously cutting open bags of deep frozen plasma, each bag having a longitudinal axis, said machine comprising a feed table, a cutting area having a cutting means for cutting the deep frozen bags of plasma on a longitudinal median portion of said bag in the direction of said longitudinal axis into two portions and a collection area for the cut bags to be separated from the plasma, said cutting means including at least one fixed position cutting nozzle emitting a cutting jet of water under very high pressure, said cutting area having a length and further including a conveyor means for continuously travelling said deep frozen bags of plasma one after another under said at least one cutting nozzle, said conveyor means including a chassis, a first horizontal roller rotatably mounted at one end of said chassis, a second horizontal roller mounted on the other end of said chassis, two side-by-side endless belts having a small gap therebetween located vertically in relation to said at least one cutting nozzle mounted around said first and second horizontal rollers, means for travelling said endless belts over said first and second horizontal rollers, and paired inclined rollers on said chassis adjacent said ends, said endless belts being oriented by said inclined rollers to form in relation to one another a very open V-shaped profile having a tip centered on said gap, said very open V-shaped profile being formed over a substantial portion of said length of said cutting area, said feed table comprising at least one shaking table having a downstream end, at least one distribution chute mounted at said downstream end and terminating at said one end of said chassis for feeding said bags to said conveyor means, deflectors mounted at said downstream end of said at least one shaking table adjacent said at least one distribution chute for orienting said bags of deep frozen plasma as said bags leave said at least one shaking table and enter said at least one distribution chute so that said longitudinal axis of each said bag is aligned with said conveyor means, and a feed flap at an exit of said at least one distribution chute for releasing each said bag regularly.

2. The machine according to claim 1, wherein said inclined rollers are idler rollers and said conveyor means further comprises vertical brackets positioned adjacent said first and second horizontal rollers and a support bearing at a top of each bracket cantilever supporting said inclined rollers.

3. The machine according to claim 1, wherein said conveyor means further includes a fixed sliding plane positioned along said chassis between said inclined rollers and having an upper face inclined in a same direction as said inclined rollers, said endless belts being supported on said upper face and slidable therealong.

4. The machine according to claim 1, further comprising a longitudinal hood covering said endless belts over portion of said chassis laterally and longitudinally with respect to a position of said at least one cutting nozzle.

* * * * *

UNITED STATES PATENT AND TRADEMARK OFFICE

CERTIFICATE OF CORRECTION

PATENT NO. : 5,361,661

DATED : November 8, 1994

INVENTOR(S) : Annick FAUCOMPRE et al

It is certified that error appears in the above-identified patent and that said Letters Patent is hereby corrected as shown below:

On the title page, Item [75], third line, change "Millard" to -- Maillard --.

Signed and Sealed this

Twenty-fourth Day of January, 1995

Bruce Lehman

*Attest:*

BRUCE LEHMAN

*Attesting Officer*

*Commissioner of Patents and Trademarks*